US007185705B2

(12) United States Patent
Fontana

(10) Patent No.: US 7,185,705 B2
(45) Date of Patent: Mar. 6, 2007

(54) SYSTEM AND METHOD FOR RECOVERING RETURN FLUID FROM SUBSEA WELLBORES

(75) Inventor: Peter Fontana, Amsterdam (NL)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/390,857

(22) Filed: Mar. 18, 2003

(65) Prior Publication Data

US 2004/0031623 A1 Feb. 19, 2004

Related U.S. Application Data

(60) Provisional application No. 60/365,367, filed on Mar. 18, 2002.

(51) Int. Cl.
*E02D 23/02* (2006.01)
*E21B 29/12* (2006.01)

(52) U.S. Cl. ..... 166/356; 175/66; 405/210

(58) Field of Classification Search ..... 175/5, 175/66, 206, 207; 166/356, 357; 405/128, 405/210

See application file for complete search history.

(56) References Cited

U.S. PATENT DOCUMENTS 3,552,131 A * 1/1971 Mott et al. ..... 405/210
3,693,733 A * 9/1972 Teague ..... 175/66
3,815,673 A * 6/1974 Bruce et al. ..... 166/359
3,891,037 A * 6/1975 Well et al. ..... 175/6
4,030,216 A 6/1977 Williams
4,149,603 A * 4/1979 Arnold ..... 175/7
4,291,772 A * 9/1981 Beynet ..... 175/5
5,820,300 A * 10/1998 Sonoda et al. ..... 405/188
5,878,814 A * 3/1999 Breivik et al. ..... 166/267
5,899,637 A * 5/1999 Blanchard et al. ..... 405/210
6,345,672 B1 * 2/2002 Dietzen ..... 175/66
6,718,900 B2 * 4/2004 Carter ..... 114/257
6,796,379 B1 * 9/2004 Martin ..... 166/356

FOREIGN PATENT DOCUMENTS

WO WO99/61745 12/1999
WO WO01/18352 3/2001

* cited by examiner

*Primary Examiner*—Thomas A Beach
(74) *Attorney, Agent, or Firm*—Madan, Mossman & Sriram, P.C.

(57) ABSTRACT

A subsea return fluid recovery system for recovering drilling fluid and cuttings ("return fluid") from a subsea wellbore in one embodiment includes a hub at the opening of the subsea wellbore that directs fluid into a transport device. In one embodiment, the hub includes a stand pipe that forms a return fluid column, the hydrostatic pressure of which causes return fluid to flow into the transport device rather than up the stand pipe. One or more buoyant members attached to the transport device convey the transport device toward the surface. A preferred recovery method includes collecting return fluid at the seabed, passively transporting the collected fluid to the surface, and processing the collected fluid at a local (offshore) or land based treatment facility. The retrieval and processing of the return fluid is done outside the critical path of the drilling activities at an offshore platform.

19 Claims, 2 Drawing Sheets

SYSTEM AND METHOD FOR RECOVERING RETURN FLUID FROM SUBSEA WELLBORES

CROSS-REFERENCE TO RELATED APPLICATIONS

This application claims priority to U.S. provisional patent application Ser. No. 60/365,367 filed on Mar. 18, 2002, titled "System and Method for Recovering Return Fluid from Subsea Wellbores."

BACKGROUND OF THE INVENTION

1. Field of the Invention

The present invention relates to systems for retrieval wellbore fluids. More particularly, the present invention relates to systems and devices for transporting return fluids from a seabed to a location on a water surface. In a different aspect, the present invention relates to methods for conveying drill fluids from a seabed to a surface location.

2. Description of the Related Art

Conventional hydrocarbon recovery operations typically include a derrick disposed over a subterranean formation bearing oil and gas deposits. For offshore hydrocarbon recovery operations, the derrick is erected on a platform at the water surface. A drill string suspended from the derrick includes a drill bit adapted to disintegrate earth and rock and thereby form a wellbore. Often, a riser extending from the platform to a subsea wellhead at a seabed or mud line is used to guide the drilling string into the formation of interest. The drill pipe or drill string can include a plurality of joints of pipe or coiled tubing, each of which has an internal, longitudinally extending bore for carrying drilling fluid from the well drilling platform through the drill string and to a drill bit. Drilling fluid lubricates the drill bit and carries away well cuttings generated by the drill bit. The cuttings are carried in a return flow stream of drilling fluid through the well annulus and is either recovered or dumped.

In some instances, the seabed has a relatively deep layer of soft sediment or earth. This soft layer can pose difficulties during offshore well construction because it is ill suited to support the heavy equipment and structures that are installed at the seabed to support drilling activities. One conventional method used to overcome this problem is to drill, case and cement a relatively deep large diameter well bore (e.g., thirty to thirty-six inch diameters). This casing thereafter provides the needed foundation for a wellhead and for hanging or supporting well head equipment. Once this casing is set the next string of casing, normally a 20" diameter surface casing, requiring that a 26" diameter hole is drilled and set using the same procedure. As can be appreciated, the drilling of such a relatively large diameter wellbore requires the removal of a substantial amount of earth and rock. Thus, a significant amount of drilling fluid is needed to flush out and convey the drill cuttings to the seabed. In certain instances, water or seawater can be used as the drilling fluid for lubricating the drill bit and removing cuttings. The returning seawater is often simply released to the marine environment in the vicinity of the wellbore. In other instances, however, seawater is not adequate to promote safe and or efficient drilling due to either insufficient pressure or weight. In these instances, drilling "mud" is used as the drilling fluid. The returning drilling "mud," like seawater, is also released at the seabed because during this operation the riser is not yet in place and conventional methods for recovering return fluid are not cost-effective. For example, a seabed-based pump having the capacity to pump the return fluid to the platform would be very expensive to deploy and operate.

Thus, there is a need for more cost-effective and efficient method of recovering the drilling mud used during this offshore drilling operation. In addition, the environmental impact of such operations would be improved immensely if the mud were to be recovered rather circulated into the sea.

SUMMARY OF THE INVENTION

The present invention provides a subsea return fluid recovery system positioned on the seabed and is deployed in conjunction with an offshore platform adapted to construct a well in a subterranean formation. The platform includes a mud pump and a drillstring extending downwards from the platform. During drilling of the surface hole, fluid, such as mud, is pumped down via the drill string into the wellbore. This fluid exits at the drill bit lubricates the cutting action of the drill bit and carries the drill cuttings up the wellbore. For convenience, the returning drilling fluid and entrained cuttings are referred to as "return fluid."

A preferred recovery system includes a distribution hub and one or more transport devices. The distribution hub controls the flow of return fluid exiting the wellbore and fills the transport device(s) with return fluid. A preferred hub includes a section of pipe (stand pipe) fixed in or positioned at the wellbore opening and a manifold that channels return fluid into one or more transport devices in either a simultaneous or sequential fashion. The transport device(s) first, collects and later, conveys return fluid from the seabed to a retrieval point at or near the water surface. A preferred transport device includes a container and one or more buoyant members. The container is an expandable or collapsible member that inflates or expands when filled with fluid. Alternatively, the container is a relatively inflexible vessel. The buoyant members provide a buoyancy force for raising the transport device towards the surface once the drilling operation has been completed. The buoyant members are charged with a "light" medium upon activation by either a local or remote source. This could include a subsea source activated by a remotely operated vehicle (ROV), a surface source via an umbilical, and/or a pre-charging mechanism.

The present invention also provides a method for recovering return fluid. A preferred method includes collecting the return fluid at the seabed, transporting the return fluid to the water surface, retrieving, and treating/processing the return fluid. Thereafter, the processed return fluid can be reused in further drilling operations. Preferable, most or all of these activities are done "off-line" or outside the critical path of the drilling activities at the offshore drill rig.

During fluid collection, a return fluid column is formed in the stand pipe and has a sufficient height above the manifold such that the hydrostatic pressure of the return fluid column forces fluid into the transport device(s). The hydrostatic pressure of the return fluid column is controlled by the height of the stand pipe such that there is generally sufficient hydrostatic pressure maintained above the manifold. Because the height of the stand pipe creates sufficient hydrostatic pressure of the return fluid, the return fluid flows through the manifold and into the container(s) of the transport device(s). In one arrangement, the mud pump rate is used to control the hydrostatic pressure of the return fluid column. Transportation of the return fluid to the surface can commence after a predetermined condition has been met, e.g., the capacity of the container has been reached. For transportation, the buoyant members can be charged before the condition has been met, after the condition has been met, or some combination thereof. In any case, once the transport device is positively buoyant, the transport device floats to the surface or some intermediate point for recovery by a service vessel. The return fluid can be treated (e.g., recycled) at an offshore or land location. Further, recycled return fluid can be returned to the platform for reuse.

The recovery system and method can be enhanced by the use of sensors and microprocessors. For example, one or more sensors operatively connected to a processor can control mud pump operation to maintain the juncture at a desired level or point. Other sensors can be adapted to provide signals that aid in the collection of return fluid within the transport device.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
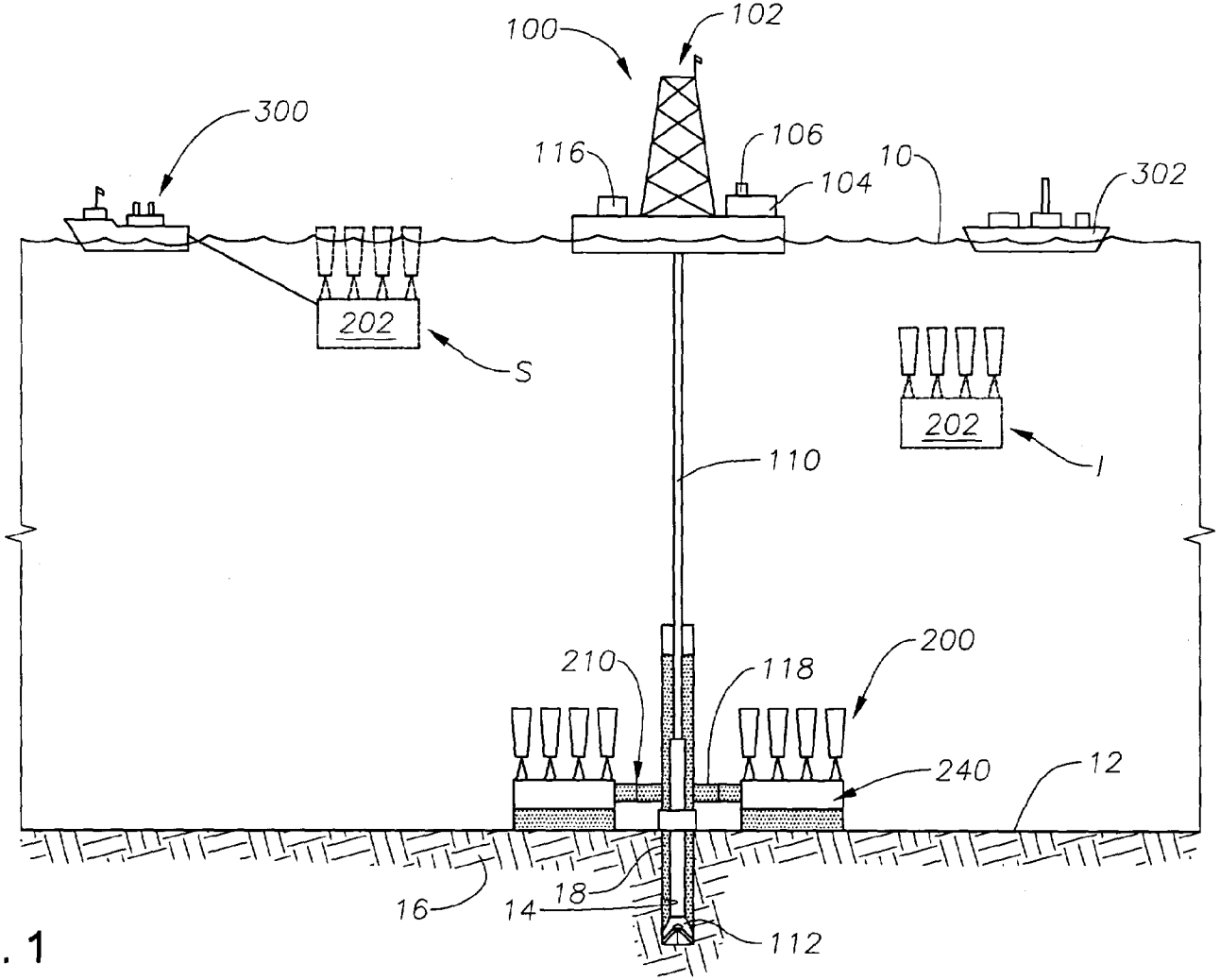
FIG. 1 schematically illustrates an elevation view of a preferred return fluid recovery system deployed in conjunction with an offshore platform.

The present invention relates to devices and methods for conveying return fluid from the seabed to a surface location. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is shown an offshore platform 100 at the water surface 10 and preferred embodiment of a subsea drilling fluid and cuttings ("return fluid") recovery system ("recovery system") 200. The recovery system is positioned on the seabed 12. Preferably, the recovery system includes a distribution hub 210 and a transport device 240. During drilling operations, the distribution hub 210 selectively fills one or more transport devices 240 with drilling fluid and cuttings ("return fluid"). During filling or some time after filling is complete, the transport device 240 is made positively buoyant. Once positively buoyant, the transport device 240 floats upward. Depending on the retrieval method used, the transport device 240 can either float to a surface location S or remain at an intermediate submersed location I. Upon retrieval, the return fluid can be processed and re-used.

The platform 100 is adapted, in part, for the construction of a well in a subterranean formation. Accordingly, the platform 100 includes equipment such as a derrick, rotary table, a Kelly, drawworks, and other known equipment employed to form a wellbore in a subterranean formation (collectively referred to with numeral 102). Also positioned on the platform 100 are a surface mud pump 104 and a pump controller 106. A drillstring 110 and a connected drill bit 112 extend into the wellbore 14 formed in a subterranean formation of interest 16.

During drilling operations, the surface mud pump 104 pumps drilling fluid to the wellbore 14. The pump controller 106 can operate the mud pump 104 to control one or more parameters of the pump output or effluent (e.g., pressure or flow rate). An exemplary controller 106 can include one or more microprocessors having a memory programmed with instructions. These instructions can, for example, vary pump operation in order to provide drilling fluid at a predetermined pressure or flow rate. Additionally, the controller 106 may utilize the signals from one or more sensors 118 located at the subsea drilling recovery system 200. These sensors 118, for example, can detect a parameter of interest such as hydrostatic pressure or flow rate. These sensors 118 may also be used to detect a condition such as whether the capacity of a transport device 240 has been reached or whether return fluid has reached a particular level within the hub 210. Mud pump 104 operations can also be partly or fully controlled by human operators. In any event, the drilling fluid provided by the mud pump flows downward through the drill string 110 and exits at the drill bit 112. The flow of this drilling fluid cools and lubricates the drill bit 112 as the bit 112 rotates to disintegrate the earth and rock of the subterranean formation 16. This fluid also carries the cuttings of earth and rock up through an annulus 18 formed between the wellbore wall and drill string 110. For convenience, the fluid flowing up the well bore will be referred to as the "return fluid."

Figure 2:
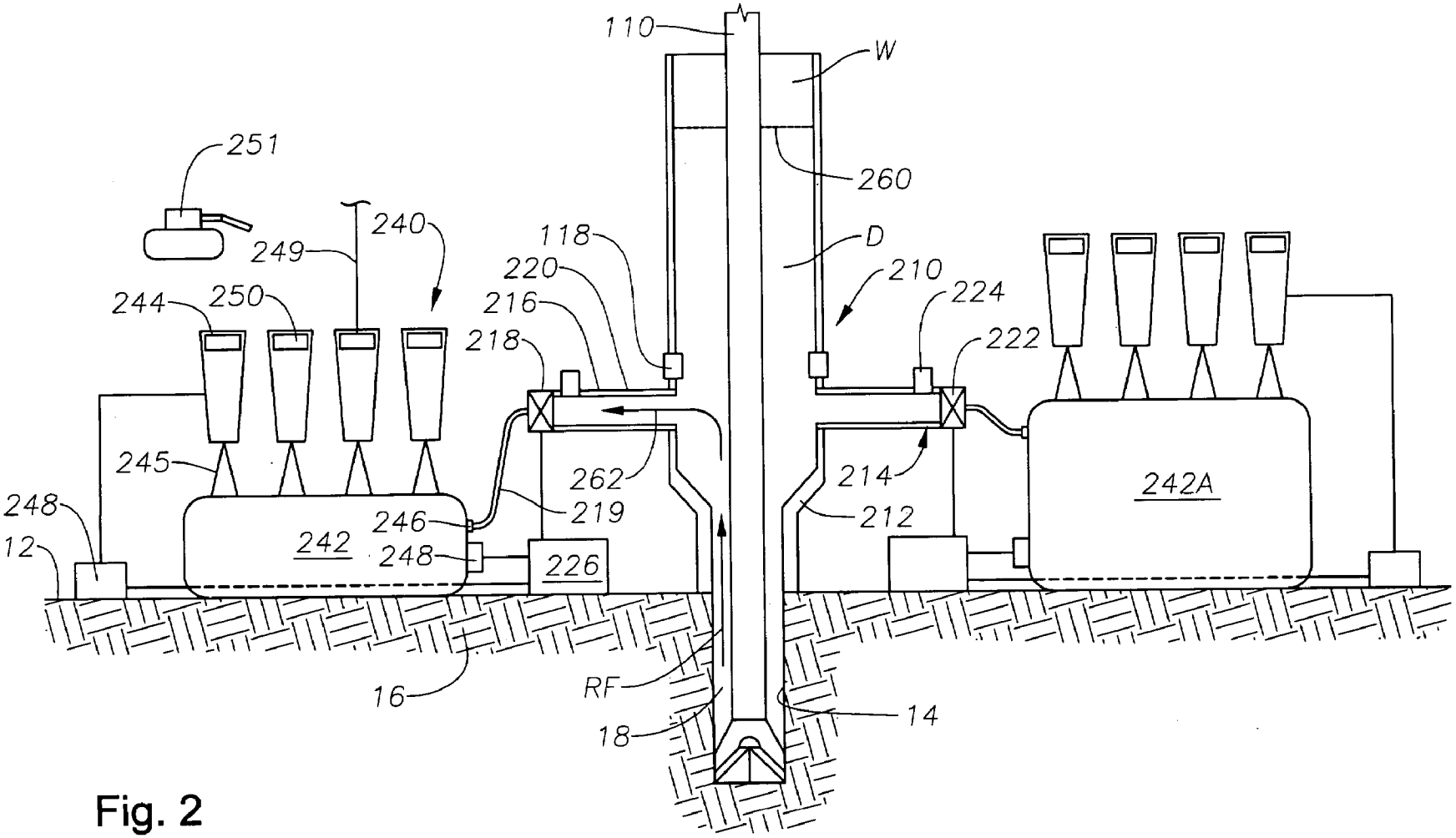
FIG. 2 illustrates a sectional elevation view of a preferred distribution hub and transport device made in accordance with the present invention.

Referring now to FIG. 2, there is shown an exemplary distribution hub 210 and transport device 240 positioned at the seabed 12 above the subterranean formation 16. The distribution hub 210 controls and directs the flow of return fluid RF exiting the wellbore 14. As will be discussed in further detail later, the distribution hub 210 makes advantageous use of the hydrostatic pressure of return fluid to direct return fluid into one or more transport device 240. Further, the hub 210 can be configured to fill a single transport device 240 with drilling mud or fill two or more transport devices 240 in either a simultaneous or sequential fashion. A preferred distribution hub 210 includes a stand pipe 212 and one or more manifolds 214. Known devices such as seals and valves may be used to limit or control the flow of fluids between the interiors of the hub 210 and the surrounding water. Furthermore, in applications where it is desirable to assist the flow of return fluid RF through the manifold 214, a subsea pump (not shown) can be positioned in fluidic communication with the manifold 214 to pump the return fluid RF into the transport device 240.

The stand pipe 212 guides drill string 110 and other tools into the wellbore 14. The stand pipe 212 is positioned adjacent the opening of the wellbore 14.

The manifold 214 channels the flow of fluids, such as drilling mud and entrained cuttings, from the interior of the hub 210 into one or more transport devices 240. In one embodiment, the manifold 214 has at least one pipe member 216 that radiates outward in a spoke-like fashion. Each pipe member 216 includes a first end 218 adapted to connect or attach with a transport device 240 and a second end 220 in fluid communication with the interiors of the hub 210. A flexible tube or pipe 219 may be attached to the first end 218 to provide a flexible fluid conduit to the transport device 240. Devices such as one-way check valves 222 may be used to meter or otherwise control the flow of return fluids through the manifold 214. Additionally, sensors 224 in fluidic communication with the manifold 214 can detect parameters of interest including, but not limited to, pressure, flow rate, and the composition of the fluid flowing through the manifold 214. These sensors 224 can provide signals via the telemetry system 116 (FIG. 1) to a surface processor, such as pump controller 106 (FIG. 1), and/or a subsea processor 226. In one arrangement, therefore, the processor 226 can utilize sensor signals to control the fluid flow in the manifold 214 by, for example, issuing instructions that open or close the valve 222. As will be apparent in the discussion below, processor 226 may include one processor or a plurality of processors, each of which is programmed to control a particular activity.

The transport device 240 collects and conveys return fluid RF from the seabed 12 to a retrieval point at or near the water surface 10. A preferred transport device 240 includes a container 242 and one or more buoyant members 244. In a preferred embodiment, the container 242 is a bladder-like or balloon-like member that inflates or expands when filled with fluid; e.g., a collapsible bag. The container 242 is preferably sufficiently sturdy to be towable through the water for extended distances. Known bags adapted for transporting potable water across the ocean are exemplary of one design that may be suitable for the container 242. Moreover, it is also preferred that the container 242 is suitable for repeated use; i.e., two or more cycles of filling, discharge, and towing. Nonetheless, a disposable container 242 may be adequate for many applications. In another embodiment, the container 242 is a relatively inflexible vessel. Depending on the container 242 design used, the container 242 may be formed of an elastic material, a composite material, a metallic material or a hybrid material. In either arrangement, fluid enters the container 242 via one or more ports 246. Devices such as quick disconnect coupling (not shown) may be used to attach the container 242 to the flexible tube 219 or directly to the hub pipe member end 218. This coupling can be adapted to selectively shut off the flow of fluid into the container 242 after a desired or predetermined condition has been detected. For example, one or more sensors 248 positioned inside or adjacent the container 242 can transmit a signal to the processor 226 when the carrying capacity of the container 242 has been reached. These sensors 248 may also detect conditions such as pressure or flow rate.

In a preferred embodiment, the buoyant members 244 provide a buoyancy force for raising the transport device 240 to or near the surface 10. Preferably, the buoyant members 244 are filled with a fluid that is lighter than the surrounding water in order to provide the desired positive buoyancy. Such fluids include gases such as air and liquids such as kerosene. It will be understood by one of ordinary skill in the art that the buoyant members 244 can also incorporate a solid floatation material such as foam to provide a predetermined amount of constant buoyancy. Buoyant members used in salvaging operations, such as for recovering sunken vessels, are exemplary of one design that may suitable. The buoyant members 244 can be connected to the transport devices 240 with ropes, belts, wires or other known tethering or harness devices 245.

Further, the buoyant members 244 can be charged or filled with fluid by either a local or remote fluid source. In a preferred arrangement, the buoyant members receive a fluid from a subsea fluid source 248 via a known means such as hose line. In another preferred arrangement, the buoyant members 244 receive a fluid from a surface source (not shown) via an umbilical 249. In still another preferred arrangement, the buoyant members 244 include a pre-charging mechanism 250 may be used to charge the buoyant members 244 on demand or upon the occurrence of a pre-defined condition. The buoyant members 244 can be activated with the controller 226, a controller in a remote location (not shown) such as on the platform 100 (FIG. 1), or a combination thereof. Additionally, a remotely operated vehicle 251 or a diver can activate the buoyant members 244. From the foregoing, it will be appreciated that the transport device 240 provides a passive method of transporting return fluid RF to the surface.

It should also be appreciated that the buoyant members 244 may in used in several advantageous arrangements. In an exemplary arrangement, a first set of pre-filled or pre-charged buoyant members 244 provide a constant or base line buoyancy and a second set of buoyant members 244 are selectively filled until the transport device 240 become positively buoyant. In another exemplary arrangement, the buoyant members 244 are filled after the container 242 has been substantially filled with return fluid RF. In still another exemplary arrangement, the buoyant members 244 are filled while the container 242 is receiving return fluid RF. Thus, advantageously, one or more of the buoyant members 244 can be in a non-buoyant state (e.g., negatively buoyant), a semi-buoyant state (e.g., neutrally buoyant), or a buoyant state (e.g., positively buoyant). It should be understood that there is considerable degree of variation within each of these states (e.g., slightly negatively buoyant to very negatively buoyant).

It will be apparent to one of ordinary skill in the art that the transport device 240 is amenable to numerous adaptations and modifications. For example, the buoyant members 244 may be integral with the container 242. Alternatively, the buoyant members and containers can detachable. A detachable buoyant member provides the flexibility to be mounted or attached to the container either before or after the container 242 is fluidicly connected to the hub 210; i.e., in fluid communication with the return fluid RF. In another modification, the transport device 240 may include one or more ballast tanks that may be filled or evacuated as necessary to provide a desired amount of buoyancy. Further, the transport device 240 can be adapted to be self-propelled (e.g., propelled by a motorized propeller) or pulled to the water surface (e.g., by a cable extending from a surface winch). Still further, a remotely operated vehicle 251 can be used to guide or tow the transport device 240 to a predetermined location. Additionally, devices such as a beacon may be attached on the transport device 240 to monitor movement and/or assist in locating the transport device 240.

Additionally, the collection of return fluid RF and release of the transport devices 240 can be controlled manually, by one or more processors 226, or a combination thereof. In one arrangement, the return fluid RF gradually fills the container 242 to capacity. Thereafter, a diver closes a valve 222 to prevent fluid communication between the manifold 214 and the container 242 and actuates any release mechanisms or anchors (not shown) that restrain the transport device 240. The diver can also initiate the charging of the buoyant members 244 to make the transport device 240 positively buoyant. In a different arrangement, the sensors 248 positioned within the container 242 can provide a signal to the processor 226 that the container 242 capacity has been reached or that some other condition has been met. In response to the signal, the processor 226 can close the valves 222, disengage any connections or anchoring devices, and charge the buoyant members 224. It should be apparent that the processor 226 may be programmed to perform one or more of these tasks with human intervention at predetermined points.

Further advantages of the present invention will become evident in the following discussion of the method of recovering return fluid. A preferred method includes collecting return fluid at the seabed, transporting the return fluid to the water surface, retrieving the return fluid, and treating the return fluid.

Referring now to FIGS. 1 and 2, during fluid collection, the stand pipe 212 is flooded with water to form a water column W. This water column can span a portion of the length of the stand pipe 212. The drilling fluid flows out of the drill bit 112 and upward along the wellbore annulus 18 to form a drilling mud column D. The water column W and the return fluid column D meet or contact at a juncture 260 located approximately above the manifold 214. Because the hydrostatic pressures of the drilling mud column D and possibly that of the water column W, the return fluid RF cannot flow up the stand pipe 212. Rather, the return fluid RF flows through the manifold 214 and into the container 242 of the transport device 240 as shown with arrows 262. Thus, the hydrostatic pressure of the mud column D provides a passive method for channeling the flow of the return fluid RF. It should be understood that in certain embodiments one or more pumps may be in a primary or supplement role in channeling the return fluid RF.

Transportation of the return fluid RF to the surface occurs after the capacity of the container 242 has been reached. If the container 242 includes an expandable bag, then transportation can commence upon the container 242 reaching a substantially expanded state 242A. Other pre-determined criteria or conditions may also be used as guide for determining when to transport the collected return fluid RF to the surface. As described above, the buoyant members 244 provide the motive force for bringing the collected return fluid RF to the surface. Because it may take some time to charge the buoyant members 244 with sufficient fluid to make the transport device 240 positively buoyant, the charging operation may be sequenced to begin before the filling of the container 242 is complete. For example, a first buoyant member or set of buoyant members can be charged upon the container 242 reaching a first predetermined fill level, a second buoyant member or set of buoyant members charged upon reaching a second predetermined fill level, and so on until the container 242 is filled. Another exemplary sequence can have one or more buoyant members being gradually charged while the container 242 is filled with return fluid. It should be appreciated that these arrangements will reduce the time required to bring a filled transport device 240 to the water surface for collection. Alternatively, the buoyant members 244 can be charged with a relatively light fluid after the container 242 is full. In another embodiment, the filled container 242 is left at the seabed for an extended period, perhaps days or weeks.

In any case, once the transport device 240 is positively buoyant, the transport device 240 floats to the surface S or some intermediate point I for recovery by a service vessel 300. It should therefore be appreciated that the tasks associated with the recovery, processing and reuse of the return fluid can be executed "off-line" or outside of the critical path of the drilling activities at the rig 100.

An exemplary retrieval or recovery operation can involve the service vessel 300 towing one or more transport devices 240 to a the offshore rig 100, a processing facility that is land based facility (not shown), or an offshore facility 302. The transport device 240 can be either at the surface or submersed a predetermined depth below the surface 10. In another exemplary operation, the service vessel 300 extracts the transport device 240 out of the water for transport to a processing facility. In yet another recovery operation, some or all of the return fluid RF is pumped out of the transport device 240. The partially or fully empty transport device 240 can, thereafter, be towed to a processing facility or left behind.

Treating or processing of the fluid can be performed either locally, i.e., near the platform 100 by the offshore facility 302, or at a remote location (not shown). For example, the transport device 240 can be docked next to an offshore facility (e.g., a floating platform or barge) and drained of the return fluid. The fluid can either be treated or processed for disposal or recycled. The recycled fluid can conveniently be transported to the platform 100 with a new or refurbished transport device 240. For example, the transport device 240 can be re-filled with clean (e.g., new or treated) return fluid, and towed back to the platform 100. It should be appreciated that the process of recovering and treating or processing the return fluid does not require the resources (e.g., deck space, personnel, equipment, etc.) of the platform 100 used to construct the well. Thus, platform 100 equipment and personnel can be directed to critical path activities (e.g., wellbore drilling).

Execution of one or more of these processes can be enhanced by the strategic use of sensors and microprocessors. For example, sensors, such as sensors 118 and 224, positioned along the stand pipe 212 and at the fluid recovery system 200 can be adapted to provide signals useful during operation. In a first instance, pressure transducers along the stand pipe 212 and manifold 214 can provide real time or near real time indication of the pressure or pressure changes within the water column W or return fluid column D. Additionally, sensors may be used to detect whether the juncture 260 of the water column W and return fluid column D has passed a predetermined location within the hub 210 and/or along the stand pipe 212. For example, a sensor may be configured to detect the differences in the electrical properties of a fluid and thereby distinguish between water and drilling mud. The subsea processor 226 can be operatively connected to receive signals from these sensors and programmed to alter equipment such as mud pumps 104 or valves, such as valves 222, accordingly. For example, upon detecting a signal that the water column W is extending into the manifold 214, the processor 226 can instruct the mud pump 104 to increase flow rate to thereby increase the drilling mud hydrostatic pressure. The processor 226 may also be programmed to actuate a valve to momentarily restrict flow rate if it detects that drilling mud column D extends too far into the stand pipe 212. Thus, it should be appreciated that the processor and one or more suitably adapted sensors can cooperate to maintain the flow of return fluid into the transport devices 240 in a substantially closed loop fashion. The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

The invention claimed is:

1. A method for recovering return fluid returning to sea bed during drilling of a subsea wellbore the method comprising:

pumping drilling fluid down a drill string into the subsea wellbore, the fluid and entrained cuttings flowing up an annulus between the drill string and the subsea well bore being the return fluid;

conveying at least a portion of the return fluid exiting the subsea wellbore into a container;

transporting the container to the surface;

forming a return fluid column in a stand pipe at an exit of the subsea wellbore; and controlling the hydrostatic pressure of the return fluid column to channel the return fluid into the container.

2. The method of claim 1 further comprising conveying the container to one of (a) an offshore processing facility and (b) a land-based processing facility.

3. The method of claim 1 further comprising processing the return fluid for re-use in one of (i) further drilling of the subsea wellbore; and (ii) drilling of a separate subsea wellbore.

4. A method for recovering return fluid returning to sea bed during drilling of a subsea wellbore the method comprising:

pumping drilling fluid down a drill string into the subsea wellbore, the fluid and entrained cuttings flowing up an annulus between the drill string and the subsea well bore being the return fluid;

conveying at least a portion of the return fluid exiting the subsea wellbore into a container;

transporting the container to the surface;

drilling a first well section of the subsea wellbore; filling the at least one container at least partially with the return fluid; and raising the at least one buoyant member toward the surface after substantially completing drilling the first well section of the subsea wellbore.

5. The method of claim 4 further comprising drilling a second well section of the subsea wellbore while recovering the container.

6. A system for recovering drilling fluid and entrained cuttings returning to sea bed (return fluid) during drilling of a subsea, the method comprising:

(a) a transport device adapted to collect the return fluid and raise the return fluid toward the surface, said transport device being selectively buoyant; and (b) a hub in fluid communication with said transport device and the subsea wellbore, said hub adapted to selectively direct the return fluid into said transport device.

7. The system of claim 6 wherein said transport device comprises a collapsible container adapted to receive the return fluid.

8. The system of claim 6 wherein said transport device comprises at least one buoyant member that is selectively buoyant, said buoyant member raising said transport device toward a water surface when in a buoyant state.

9. The system of claim 6 wherein said transport device comprises at least one buoyant member and a pre-charging mechanism associated with said buoyant member, said pre-charging mechanism being adapted to charge said at least one buoyant member with a relatively light fluid when activated.

10. The system of claim 6 wherein said transport device is adapted to become positively buoyant upon receiving a lighter that water fluid from one of (a) a subsea fluid source; (b) a surface fluid source; and (c) a pre-charging mechanism.

11. The system of claim 6 wherein said transport device comprises a container made from one of: (i) an elastic material; (ii) a composite material; (iii) a metallic material; or (iv) a hybrid material.

12. The system of claim 6 further comprising a standpipe coupled to the subsea wellbore, said standpipe adapted to form a column of return fluid having a hydrostatic pressure that channels the return fluid into the at least one container.

13. A method of recovering return fluid returning to sea bed during drilling of a subsea wellbore-comprising:

(a) providing an offshore rig adapted to drill the subsea wellbore;

(b) drilling the wellbore using a drill string provided with a drill bit;

(c) circulating drilling fluid down the drill string and up the annulus formed between the drill string and the subsea wellbore, the fluid and entrained cuttings flowing up the annulus defining the return fluid;

(d) placing at least one container in fluid communication with the return fluid, to receive therein at least a portion of the return fluid;

(e) attaching at least one buoyant member to the at least one container, the at least one buoyant member upon activation raising the at least one container toward a water surface; and (f) raising the at least one container toward the surface by activating the at least one buoyant member.

14. The method of claim 13 further comprising conveying the at least one container to one of: (i) the offshore rig, (ii) a land facility, and (iii) a separate offshore facility.

15. The method of claim 13 further comprising processing the fluid recovered by the at least one container at one of: (i) the offshore rig, (ii) a land facility, and (iii) a separate offshore facility.

16. The method of claim 13 further comprising drilling a well section of the subsea wellbore while circulating a drilling fluid through the wellbore; filling the at least one container at least partially with the return fluid; and raising the at least one buoyant member toward the surface after substantially completing drilling the well section of the subsea wellbore.

17. The method of claim 13 further comprising forming a return fluid column in a standpipe at an exit of the subsea wellbore; and controlling the hydrostatic pressure of the return fluid column to channel the return fluid into the at least one container.

18. The method of claim 13 wherein the at least one container is one of (i) a collapsible bag, (ii) a metallic container, (iii) a composite container, and (iv) a hybrid container.

19. The method of claim 13 further comprising reusing the drilling fluid for further drilling.

* * * * *